United States Patent [19]

Bene

[11] 3,971,236

[45] July 27, 1976

[54] APPARATUS FOR TREATING AN ELONGATED WEB WITH A LIQUID

[76] Inventor: Armand Jean Bene, 17,route de Toussieu, Manissieux 69800 Saint-Priest, France

[22] Filed: July 29, 1974

[21] Appl. No.: 492,873

[30] Foreign Application Priority Data

July 30, 1973 France ..... 73.28408

[52] U.S. Cl. ..... 68/176; 68/177

[51] Int. Cl.[2] ..... D06B 3/28; D06B 23/04

[58] Field of Search ..... 68/176, 177, 184

[56] References Cited

UNITED STATES PATENTS

| | | | |
|---|---|---|---|
| 1,913,601 | 6/1933 | Leppin | 68/184 X |
| 1,917,419 | 7/1933 | Andresen | 68/176 |
| 2,320,891 | 6/1943 | Ryder | 68/176 X |
| 2,504,882 | 4/1950 | Sinclair | 68/176 |
| 3,599,447 | 8/1971 | Arashi | 68/177 |
| 3,673,826 | 7/1972 | Stanway | 68/177 X |

*Primary Examiner*—Philip R. Coe
*Attorney, Agent, or Firm*—Karl F. Ross; Herbert Dubno

[57] ABSTRACT

An elongated web is formed into the general shape of a longitudinally extending helix having a horizontal succession of turns each of which is partially submerged in a bath of treatment liquid. A guide in the form of an auger or rake keeps the turns apart and a drive element located above the guide is rotated continuously to turn the helix in the bath. A generally horizontal but inclined plate has an upper edge just below the drive element. A pump draws the treatment fluid from the bottom of the vessel and delivers it to the upper edge of the plate so as to form thereon a downwardly gravitationally flowing sheet of treatment liquid on which the turns of the web are supported as they pass from the drive element on one side of the elongated vessel to the other side thereof.

1 Claim, 5 Drawing Figures

APPARATUS FOR TREATING AN ELONGATED WEB WITH A LIQUID

FIELD OF THE INVENTION

The present invention relates to an apparatus for treating an elongated web with a liquid. More particularly this invention concerns the dyeing or similar treating of a textile workpiece such as a thread, tube, fabric strip, or the like.

BACKGROUND OF THE INVENTION

It is known to treat an elongated web in a liquid bath by forming the web into a horizontally extending helix having a horizontal succession of turns each partially submerged in the liquid bath and rotating the helix generally about its longitudinal axis to pass all of each of the turns through the bath. The turns of the helix are kept apart by means of a plurality of guide elements equispaced along the vessel containing the bath.

The helix is generally rotated about its longitudinal axis by means of a plurality of driven longitudinally extending rollers arranged above the bath so as to support the turns. Within the bath the web tends to fold over and bunch up on itself so that in reality the greater portion of the web lies under the surface of the bath.

Such arrangements are advantageous in that they provide a relatively complete treatment of the web with the liquid, as is for example necessary in dyeing operations. However, the several driven rollers above the liquid bath exert considerable tensional forces on the web, frequently causing it to break. Such breakdowns necessitate time-consuming and expensive clearing operations which decrease output efficiency.

Another disadvantage axis. such devices is that a relatively long treatment time is necessary, even though much of the workpiece lies under the surface of the bath. Yet another disadvantage is that the bath is difficult to maintain at an even temperature as is necessary for uniform treatment.

OBJECTS OF THE INVENTION

It is therefore an object of the present invention to provide an apparatus for treating an elongated web with a liquid.

Another object is the provision of such an apparatus which operates without subjecting the workpiece web to potentially damaging tensional stresses.

A further object is the provision of a system for treating a web wherein treatment time is minimized.

SUMMARY OF THE INVENTION

These objects are attained according to the present invention in a method wherein the turns of the web in the treatment vessel are at least partially supported by a sheet of liquid which is circulated down over an inclined surface situated within the bath.

Thus the system according to the present invention avoids the use of drive elements which pull at the workpiece in such a manner so as to tension it considerably, potentially breaking it or permanently stretching it. In addition the treatment time is reduced because the web is treated even when it is not below the surface of the bath.

According to other features of this invention the apparatus has a horizontally and longitudinally extending inclined support plate whose upper edge region lies adjacent and below a drive element which itself is horizontally elongated and rotated about a longitudinal axis. The guide means is provided between this drive element and the liquid bath so that the web is pulled upwardly out of the bath and over the guide by the drive element and then is deposited onto the upper end region of the support plate whence it passes downwardly over this plate to the opposite side of the vessel. The moving sheet of liquid on this support plate both supports and saturates the web so as to prevent the tensioning of this workpiece above a nominal level while at the same time allowing the treatment liquid to act on the workpiece.

In accordance with yet another feature of this invention the circulating means includes a pump, and a heat exchanger is provided in the circulating circuit so as to insure that the liquid is maintained at a constant temperature. The heater is operated by a controller which also operates the motor for the drive element and the pump jointly so that the flow speed over the support surface and the rotation speed of the drive element are matched for minimal stressing of the workpiece.

In accordance with still another feature of this invention the pump means includes a trough or longitudinally elongated reservoir chamber having an outlet slit opening at the upper end of the support surface. It is also within the scope of this invention to provide two such outlet troughs or channels one above and one below the workpiece so as effectively to saturate the workpiece from both sides.

The guide means in accordance with yet another feature of this invention comprises an auger which is continuously rotated so as to space the turns of the workpiece helix apart. It is further within the scope of this invention to compartment that portion at least of the bath below the surface thereof or to use a rake which may be longitudinally displaceable so as to keep the turns apart.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
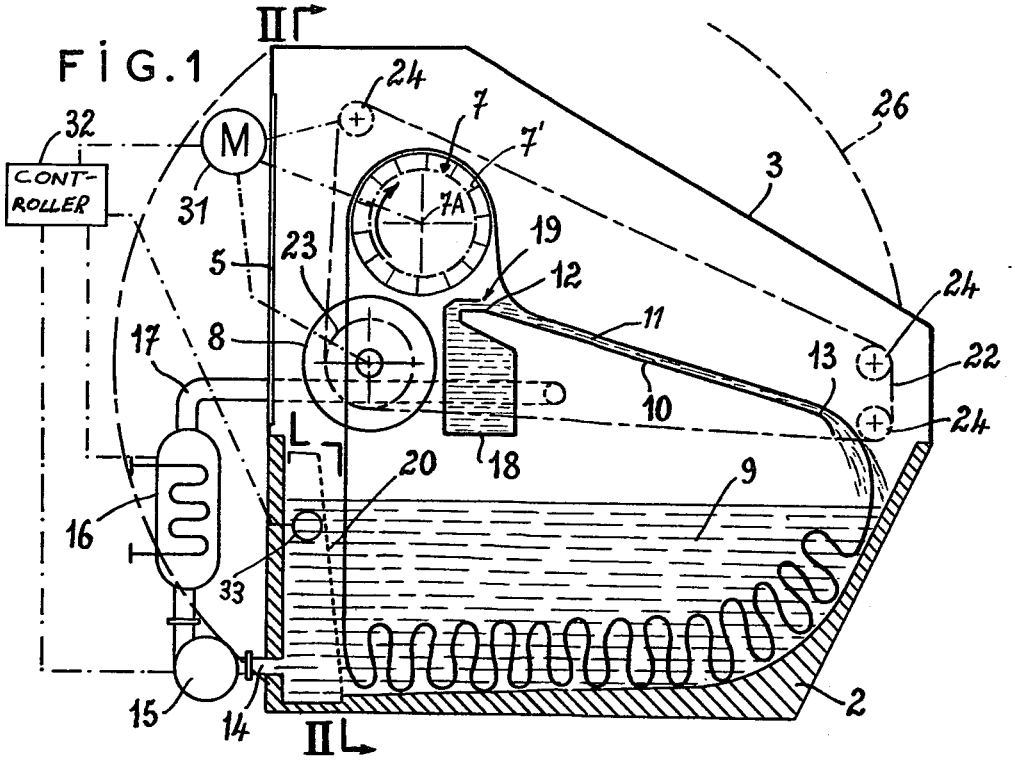
FIG. 1 is a vertical transverse section through an apparatus according to the present invention.
Figure 2:
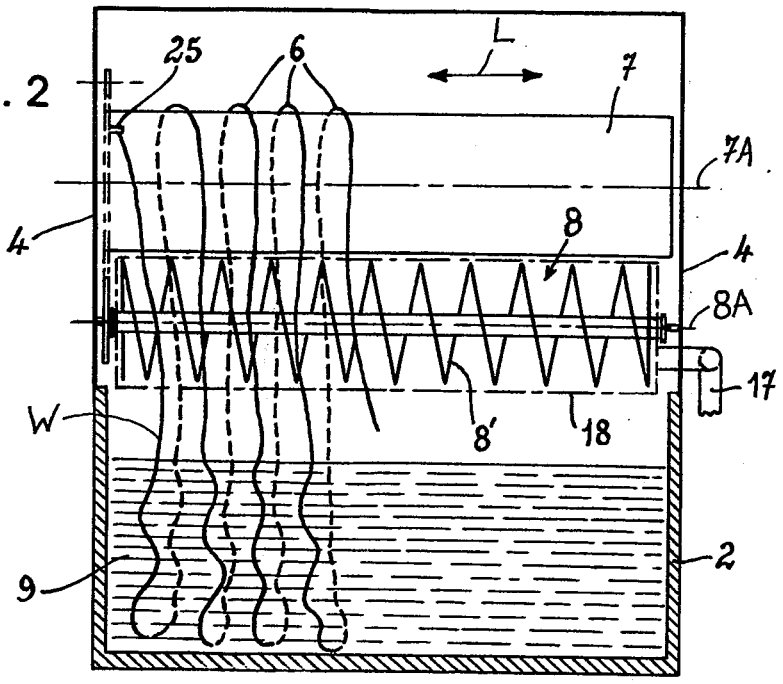
FIG. 2 is a section taken along line II—II of FIG. 1.

As shown in FIGS. 1 and 2 the apparatus according to the present invention has a vessel 2 provided with top wall 3, a pair of end walls 4, and a back wall 5, the latter being openable. This vessel 2 is elongated in the direction of double-headed arrow L (FIG. 2). An elongated workpiece web W, here a yarn, is formed inside the vessel 2 into a helix having a plurality of like turns 6.

A drive drum 7 made of stainless steel and provided with an angularly equispaced array of like rubber blades 7' is rotatable about an axis 7A parallel to the longitudinal direction L of the vessel 2. Each turn 6 of the workpiece W passes over this drive element 7 which is operated by a motor 31 in turn connected to a controller 32 programmed to operate the apparatus.

Between the element 7 and the bath 9 there is provided a guide 8 rotatable about a respective longitudinal guide axis 8A by the motor 31 and having a plurality of flights 8' and between which the turns 6 of the workpiece W are engaged. In this manner the turns 6 are kept apart. The two elements 8 and 7 are driven such that during the time it takes the drum 7 to rotate the rough helix formed by the web W through 360° the guide 8 itself turns through 360° such that the entire helix remains in the same general position within the vessel 2.

A generally horizontal and longitudinally extending plate 10 has an upper end 12 located immediately below the drive element 7 and a lower end 13 along the opposite longitudinal side of the vessel 2. This plate 10 is flat and extends the full length of the vessel 2. An elongated channel 18 similarly extending the full length of the vessel 2 has a horizontal outlet slit 19 opening at the upper edge 12 of the plate 10. A pump 15 operated by the controller 32 has an inlet 14 connected to the housing 2 adjacent the back wall 5 thereof and an outlet conduit 17 feeding into the channel 18 so as to fill this channel 18 with liquid. When the channel is completely filled the liquid issues from it at the outlet slit 19 and forms a thin film 11 on the plate 10 between the ends 12 and 13 thereof.

A heater 16 controlled by a thermostat 33 through the controller 32 maintains the liquid on the bath 9 at a constant temperature by heating it as it is circulated by the pump 15. A grill 20 is provided along the back wall 5 of the vessel 2 so as to prevent the web W from being sucked into the inlet 14.

Thus according to the present invention the workpiece is supported on the plate 10 by the liquid sheet 11 and is transported thereby toward the opposite side of the housing. This liquid sheet 11 therefore supports the workpiece W very gently so as to subject it to no rude or potentially damaging stresses. Similarly the liquid sheet 11 serves to treat the workpiece W where it is not submerged in the bath so that rather than, for example, 70% of the workpiece being completely soaked with the liquid at any one time, it is possible to have up to 90% of the workpiece in contact with a body of the liquid at any one time. This decreases the treatment time correspondingly.

A chain 22 spanned over idler rollers 24 and the drive sprocket 23 for the guide 8 is provided with a connector rod 25 to which an end of the workpiece W to be loaded into the apparatus is adapted to be connected. Thus the wall 5 is opened and the end of the workpiece is connected to the element 25 and the apparatus is started up. This connector element 25 passes over the plate 10, then under this plate and around the guide 8 and drive 7. This operation is continued until the desired length of workpiece is fed into the machine, the auger 8 automatically forming it into a helix of the desired length with the web W assuming a meander shape within the bath 9. Then the other end of the workpiece is cut, the wall 5 is closed and the entire housing is pressurized if desired so as to operate at temperatures above the boiling point of the treatment liquid in question.

Figure 3:
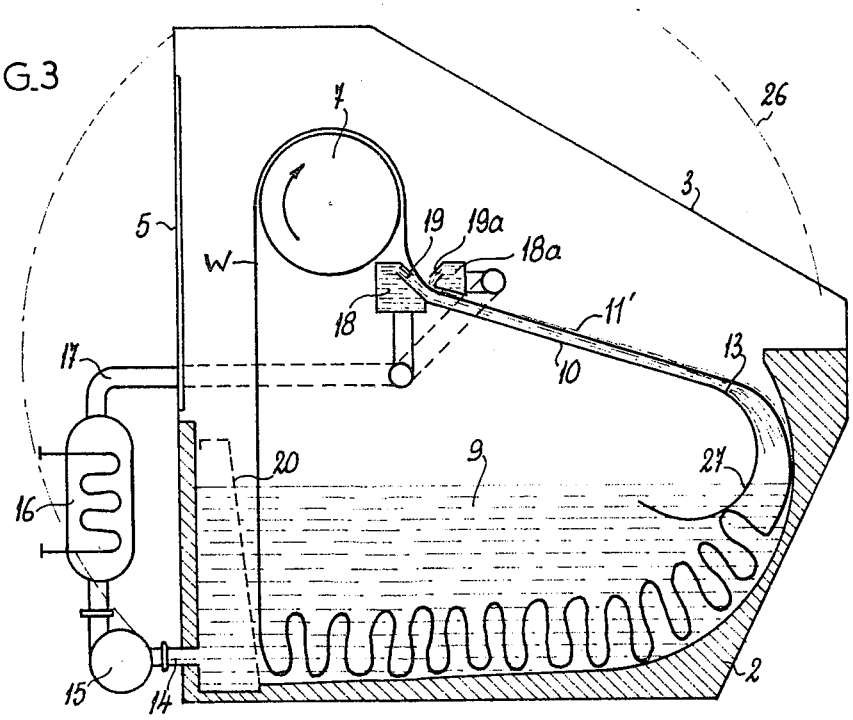
FIG. 3 is a view similar to FIG. 1 illustrating another arrangement in accordance with the present invention.

The reference numerals of FIGS. 1 and 2 are used in FIG. 3 for structurally identical elements. In this arrangement, however, there is provided a second channel 18A having outlet nozzle 19A above the plate 10 so that a sheet 11' is formed above the workpiece W as well as therebelow. In this manner the treatment time is again reduced and saturation of the workpiece W on the plate 10 is insured. In addition, the plate 10 is provided with an extension 27 projecting from its lower edge 13 and serving to insure that the liquid cascades neatly into the bath 9 and that the workpiece W is gently deposited therein.

Figure 4:
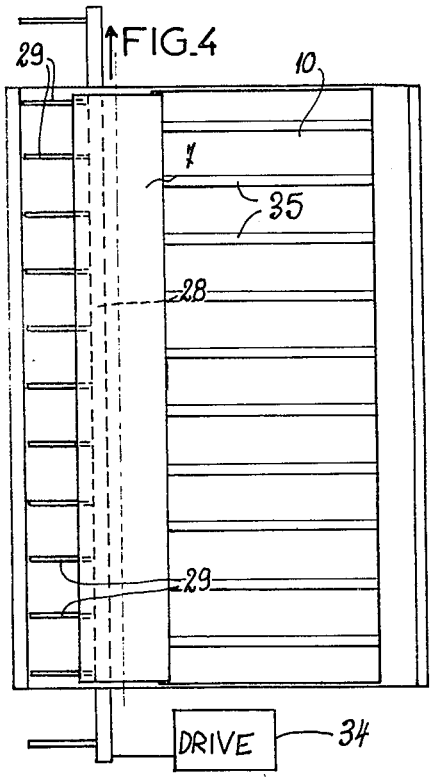
FIGS. 4 and 5 are top views of two further configurations in accordance with the present invention.

FIG. 4 shows an arrangement wherein the guide 8, not shown in FIG. 3 for clarity, is replaced by a rod 28 provided with a plurality of equispaced arms 29 acting as a rake and serving to keep the turns of the web apart. A driver 34 is provided so as to displace this rod 28 longitudinally. Downwardly extending transverse grooves 35 are formed in the slate 10 to guide the turns 6.

Figure 5:
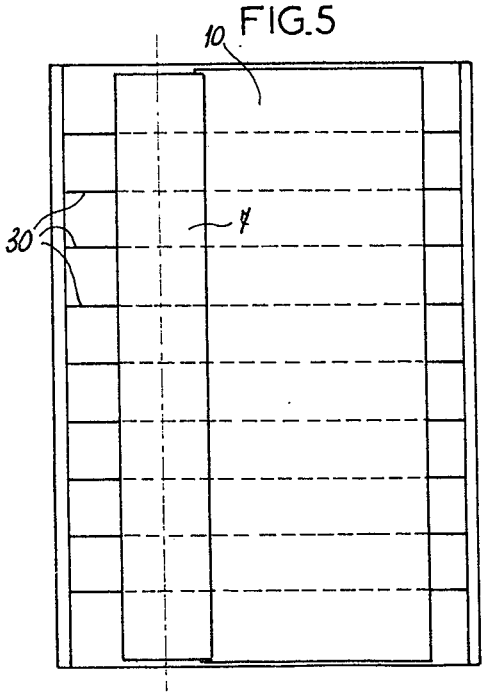

There is shown in FIG. 5 an arrangement wherein the vessel 2 is subdivided by a plurality of parallel walls 30 into a plurality of longitudinally equispaced compartments serving to keep the turns of the helix apart. These walls are perforated in accordance with the present invention so as to insure good liquid transfer and uniformity of temperature between the various compartments formed thereby.

The device according to the present invention, can be used at subatmospheric or superatmospheric pressures corresponding respectively to treatment temperatures below and above 105°C. by providing it with an airtight housing. It is also possible in accordance with the present invention to use a cylindrical housing as shown by dot-dash line 26 in FIGS. 1 and 3 so as to obtain maximum safe pressurization and thereby reduce treatment time to a minimum.

I claim:

1. An apparatus for treating an elongated web with a liquid, said apparatus comprising:

a housing having a bottom and formed at its bottom with an upwardly open vessel containing a bath of a treating liquid, said vessel having a wall inclined downwardly and inwardly for guiding said web into said bath;

a plate disposed in said housing above said bath, said plate being inclined downwardly toward and spaced from said wall for feeding said web downwardly toward the latter, said plate extending substantially horizontally in said housing and having an upper and a lower edge;

a drum rotatably mounted in said housing and disposed above and along said upper edge of said plate for laying said web onto the latter;

nozzle means for feeding a treating liquid onto said plate below said web whereby said web contacts said liquid on said plate, the liquid on said plate cascading into said bath at the lower edge of said plate;

an auger rotatably mounted in said housing between said bath and said drum and having a helical rib, said web having turns separated by said rib as said web rises from said bath onto said drum; and means for driving said auger and said drum.

* * * * *